United States Patent [19]

Lee

[11] 3,973,867

[45] Aug. 10, 1976

[54] RADIAL FLOW TYPE PUMP

[76] Inventor: Chien Fu Lee, 152-2, Lane 90, Yen Ping Road, Chung Li, Taiwan, China

[22] Filed: Apr. 9, 1975

[21] Appl. No.: 566,221

[52] U.S. Cl. ..... 415/143; 415/213 T; 415/214; 64/14

[51] Int. Cl.[2] ..... F04D 1/02

[58] Field of Search ..... 415/196, 214, 200, 143, 415/1-64, 213 T; 64/14

[56] References Cited

UNITED STATES PATENTS

| | | | |
|---|---|---|---|
| 914,283 | 3/1909 | Jackson | 415/196 |
| 2,208,057 | 7/1940 | Skitch | 415/143 |
| 2,417,600 | 3/1947 | Jutte | 415/83 |
| 2,830,445 | 4/1958 | Kressin | 64/14 |
| 2,982,986 | 5/1961 | Tupper | 415/213 T |
| 2,983,432 | 5/1961 | Tupper | 415/213 T |
| 3,394,660 | 7/1968 | Ohmann et al. | 415/200 |
| 3,459,130 | 8/1969 | Skinner | 415/131 |
| 3,476,051 | 11/1969 | Skinner | 415/143 |
| 3,516,758 | 6/1970 | Skinner | 415/143 |
| 3,545,585 | 12/1970 | Eaton, Jr. | 64/14 |
| 3,551,067 | 12/1970 | Wissman | 415/214 |
| 3,733,143 | 5/1973 | Theis, Jr. | 415/214 |
| 3,826,589 | 7/1974 | Frank et al. | 415/214 |

FOREIGN PATENTS OR APPLICATIONS

| | | | |
|---|---|---|---|
| 358,571 | 9/1922 | Germany | 415/143 |
| 4,538,588 | 5/1970 | Japan | 415/143 |

*Primary Examiner*—Henry F. Raduazo
*Attorney, Agent, or Firm*—Shoemaker and Mattare, Ltd.

[57] ABSTRACT

A pump of the type having a centrifugal auxiliary guide wheel with a circumferential transfer passage means about the periphery of the auxiliary centrifugal guide wheel for supplying fluid to a main propeller in a radial outward flow path substantially the entire length of the flow path.

10 Claims, 4 Drawing Figures

RADIAL FLOW TYPE PUMP

The present invention relates to an improved construction of a radial flow-type pump.

Conventionally the mechanism of radial flow-type pumps is generally to install a single copper blade wheel in a volute cast iron housing case to serve the purpose of pumping water, and to have a coupling also formed with cast iron, during coupling, between its two coupling blocks a rubber piece is required for connecting the blade shaft and the motor shaft.

The volute housing case formed with cast iron is not only clumsy, but also its assembly and disassembly are troublesome and it will produce scales in water and cannot be used when contacted with acid and alkalis; also during the coupling, a rubber piece is required between the two connecting blocks of the cast iron coupling and the fitting of said rubber piece always takes time; finally, the manufacturing cost of such a pump is very high.

The object of the present invention is to improve the above defects and to provide an improved construction of a light-weight, less expensive radial flow-type water pump with simple construction, which will not adversely effect the water quality and can raise its output several times with the same horsepower, specifications and caliber.

These and other features, advantages and operating principle of the construction of an improved radial flow-type pump according to the present invention is illustrated in conjunction with the accompanying drawings, wherein.

Figure 1:
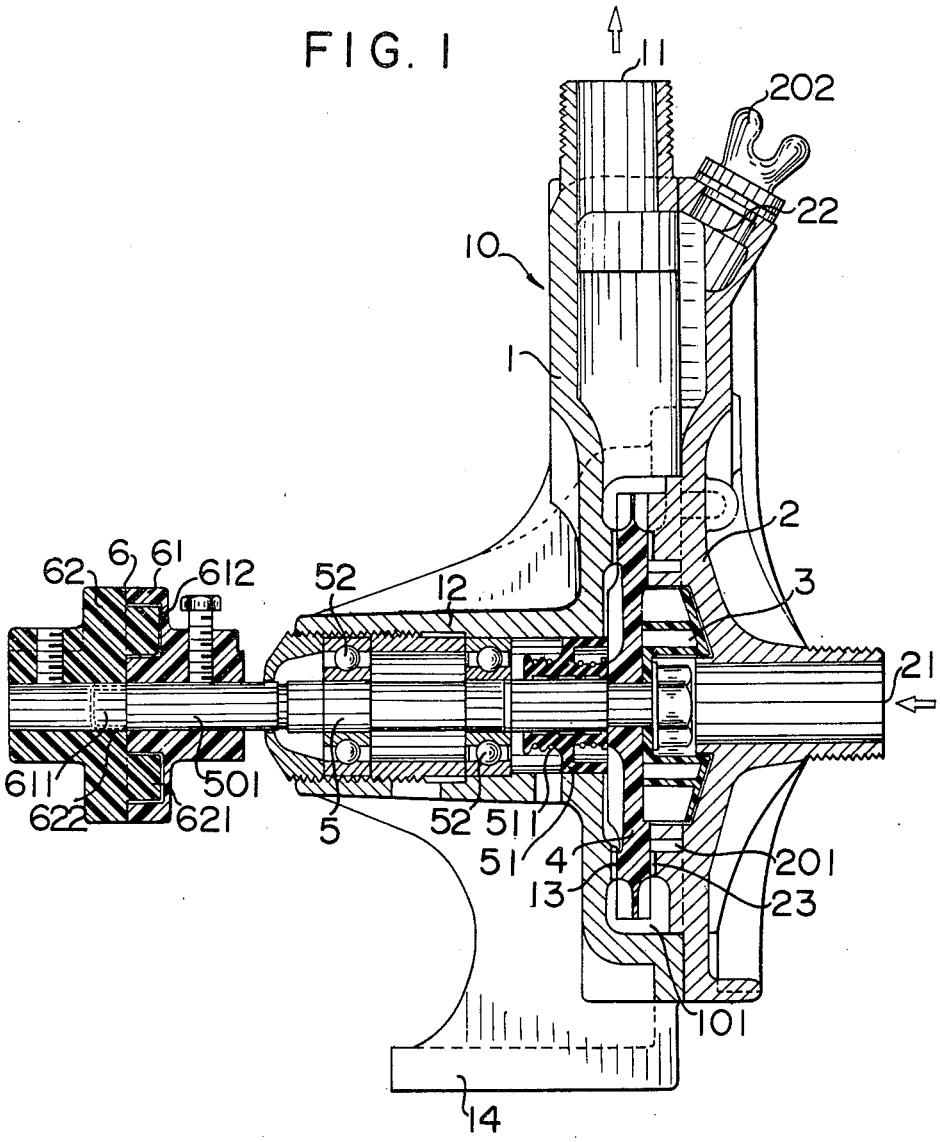
FIG. 1 is a partly cross-sectional side view of an improved radial flow-type pump according to the present invention.
Figure 2A:
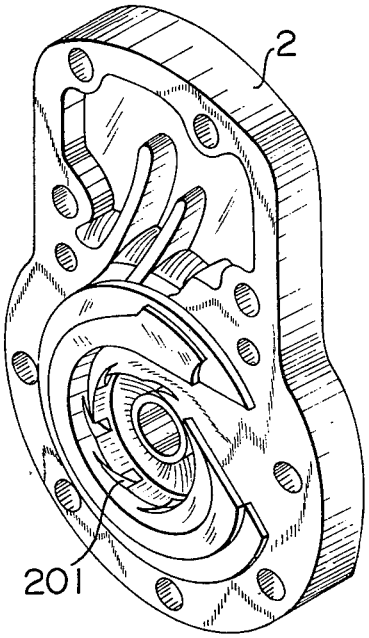
FIG. 2A is a partly cross-sectional perspective view of the cover according to the present invention.
Figure 2B:
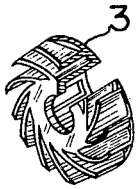
FIG. 2B is a partly cross-sectional perspective view of the auxiliary blade according to the present invention.
Figure 2C:
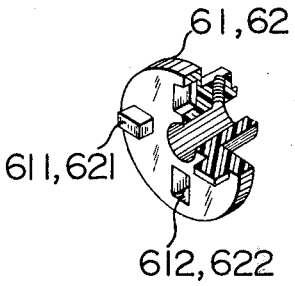
FIG. 2C is a partly cross-sectional perspective view of the coupling according to the present invention.

As shown in the figures, a volute body 10 composed of a case 1 made of nylon or cast iron and a cover 2 having a plurality of guide grooves 201-201, the upper end of said case 1 is provided with an output port 11 with threaded joint for connecting with an outlet; and the upper end of said cover 2 is provided with a pouring port 22 sealed by a nylon or ABS screw cock 202; for decreasing the friction loss between the case 1 with main blade wheel 4 shown schematically to be of the regenerative type and the cover 2 with said main blade wheel 4, two copper alloy rings 13, 23 are cast integrally with the cover 2 respectively; while at the right end of said cover 2 is provided with a suction port 21 with threaded joint for connecting with an inlet; in a volute chamber 101 inside the body 10 is provided with a Teflon, Nylon, copper or cast iron main blade wheel 4, in front of which is fitted a Nylon polypropylene, hereafter referred to as, P.P., polyvinyl chloride, hereafter referred to as PVC auxiliary blade 3 shown to be of the centrifugal type, both being adjacent and integral and fixed at the front end of a drive shaft 5, whose rear end extending outside of said case 1 is provided with a Nylon, or P.P. coupling 6, a pair of connecting blocks 61, 62 having at their end surfaces each a corresponding rectangular cubic protuberation 611, 621 and a corresponding rectangular groove 612, 622 slightly larger than said protuberations at a vertical direction with said protuberations 611, 621; when connected with a motor (not shown in the drawings) the pair of connecting blocks 61, 62 rests respectively behind the blade shaft and the motor shaft (not shown), easily making said protuberations 611, 621 to correspondingly insert into said grooves 612, 622 for accomplishing the purpose of coupling.

When the motor is actuated to operate the pump, the rotation of an auxiliary blade 3 will pump the water from the inlet (not shown) through the suction port 21 by the action of the auxiliary blade 3, via the guide grooves 201—201 in the cover 2 to enter the adjacently installed main blade wheel 4 and to exhaust by the action of said wheel 4 and to be conveyed to desired location by means of an outlet (not shown) via the output port 11. Thus, the experimental results of using the auxiliary blade 3 as suction means and the main blade wheel 4 as output device, the capacity of the improved pump according to the present invention is two-fold of that of a conventional pump with the same horsepower, specification and caliber.

I claim:

1. A fluid pump comprising:

a pump casing having defined therein a fluid inlet and a fluid outlet;

a rotatable drive shaft rotatably connected to said casing and rotatably driven by a motor;

a main fluid propeller of the regenerative type mounted on said drive shaft in said casing to be rotatable therewith and in fluid communication with said outlet;

an auxiliary fluid propeller of the centrifugal type mounted on said drive shaft for rotation therewith, said auxiliary fluid propeller being located between said fluid inlet and said main fluid propeller, said auxiliary propeller having fluid guiding means positioned thereon to receive fluid from said fluid inlet and guide it radially outwardly of said main fluid propeller for substantially the entire length of said fluid guiding means; and fluid transfer means located circumferentially about said guiding means and in fluid communication with said fluid guiding means and located on said pump casing to receive fluid from said fluid guiding means and guide it radially outwardly of said main fluid propeller over substantially the entire length of said transfer means for transferring said fluid to said main fluid propeller in a manner such that said fluid moves radially outwardly of said main fluid propeller during transfer to same so that fluid movement on a fluid path from said inlet to said outlet via said propeller means is directed radially outwardly of said main propeller for substantially the entire length of said fluid path.

2. The pump defined in claim 1, wherein said auxiliary fluid propeller comprises Nylon.

3. The pump defined in claim 1, wherein said auxiliary fluid propeller comprises polypropylene.

4. The pump defined in claim 1, wherein said auxiliary fluid propeller comprises polyvinyl chloride.

5. The pump defined in claim 1, wherein said auxiliary fluid propeller comprises steel.

6. The pump defined in claim 1, wherein said auxiliary fluid propeller comprises cast iron.

7. The pump of claim 1, further including a coupling connecting said drive shaft to said motor, said coupling including a pair of connecting blocks each having at their end surfaces a corresponding rectangular cubic protuberation and a corresponding rectangular groove which groove is slightly larger than and vertically disposed with said rectangular cubic protuberations so that said protuberations can be inserted into said grooves for joining said drive shaft to said motor.

8. The pump of claim 7, wherein said coupling comprises Nylon.

9. The pump of claim 7, wherein said coupling comprises polypropylene.

10. A fluid pump comprising:

a pump casing having a fluid outlet defined therein;

a rotatable shaft mounted in said pump casing and rotatably driven by a motor;

coupling means on said shaft for connecting said motor to said shaft to rotate said shaft;

a main fluid propeller of the regenerative type mounted on said rotatable shaft for rotation therewith and in fluid communication with said outlet;

a casing cover mounted on said casing and having defined therein a fluid inlet, a curved receiving chamber located adjacent said main fluid propeller and encircling said fluid inlet to define a perimeter which is radially spaced apart from said inlet, and a plurality of spaced apart fluid guide grooves each having one end thereof defined in said perimeter and extending outwardly therefrom and being in fluid communication with said main fluid propeller to guide fluid from said inlet along a first fluid path which is directed outward of said main propeller for substantially the entire length of said path; and an auxiliary fluid propeller of the centrifugal type mounted on said rotatable shaft for rotation therewith and received in said receiving chamber to be located adjacent said main fluid propeller and said fluid inlet, said auxiliary fluid propeller having defined therein a fluid receiving chamber located to receive fluid from said fluid inlet and a plurality of fluid guide vanes defining a plurality of spaced apart fluid passages which are in fluid communication with said fluid receiving chamber and which extend outwardly therefrom to define a second fluid path which is directed outwardly of said main propeller for substantially the entire length of that path, said fluid passages being in fluid communication with said spaced apart fluid guide grooves so that said fluid inlet and said fluid outlet are in fluid communication with each other via said auxiliary and main fluid propellers and fluid is guided along said first and second fluid paths to be directed outwardly of said main propeller so that fluid is transferred thereto in a direction which causes that fluid to move outwardly of said main fluid propeller.

* * * * *